United States Patent [19]

Nicolaus

[11] 4,148,331

[45] Apr. 10, 1979

[54] COIN-AGITATING METHOD AND MEANS FOR COIN-COUNTING AND DISPENSING MACHINES

[75] Inventor: Frank G. Nicolaus, Chicago, Ill.

[73] Assignee: Bally Manufacturing Corporation, Chicago, Ill.

[21] Appl. No.: 805,286

[22] Filed: Jun. 10, 1977

[51] Int. Cl.[2] ..... G07D 3/14

[52] U.S. Cl. ..... 133/8 R

[58] Field of Search ..... 133/3 R, 3 A, 3 H, 8 R, 133/8 C, 4 R; 221/167–170; 366/314, 279

[56] References Cited

U.S. PATENT DOCUMENTS

| | | | |
|---|---|---|---|
| 3,939,954 | 2/1976 | Collins | 133/8 R |
| 3,942,544 | 3/1976 | Breitenstein et al. | 133/4 R |

*Primary Examiner*—Stanley H. Tollberg

*Attorney, Agent, or Firm*—Callard Livingston

[57] ABSTRACT

A coin agitating attachment for use on rotary coin transport discs fed by a coin hopper for coin-dispensing and counting machines. The attachment can be made in several configurations of elastomeric materials each characterized by at least a superficial resiliency of limited stiffness such that any point of impact with or by a coin presents a yieldable contact surface which is nevertheless sufficiently rigid to repel and drive the coins while retaining the original shape or configuration.

12 Claims, 7 Drawing Figures

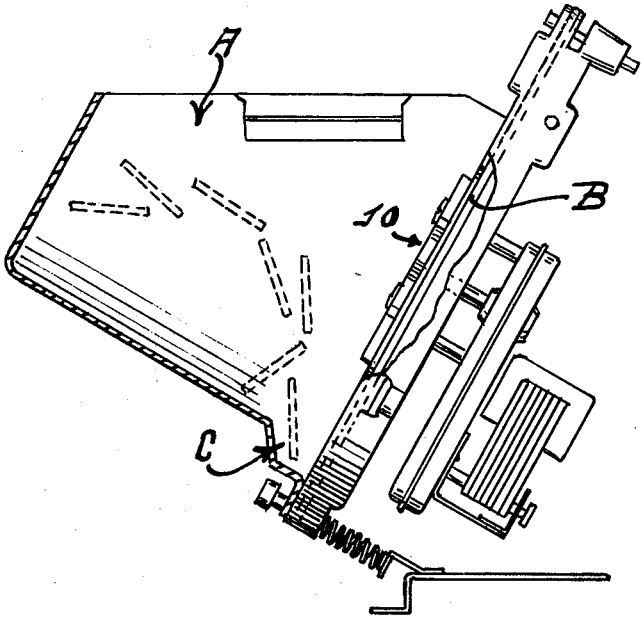
Fig. 1.
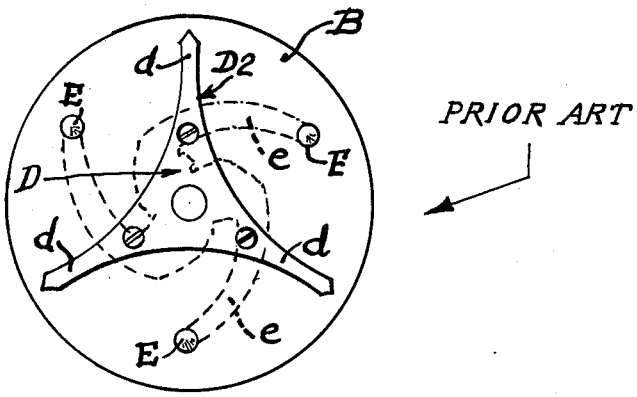
Fig. 1-A.

COIN-AGITATING METHOD AND MEANS FOR COIN-COUNTING AND DISPENSING MACHINES

The invention provides an improved method and means for agitating coins which are fed by gravity from an inclined hopper against the face of a rotating inclined coin transport disc having coin-receiving pockets into which the coins tumble for transport serially to a higher level at which they are counted and discharged. An example of this type of machine is illustrated schematically in FIG. 1 of the drawings herein.

Such machines generally provide an arcuate trough or gutter at the lower end of the hopper through which the foot of the disc rotates and into which the coins gravitate and tumble to assume positions approximating the inclination of the disc for lodgement in the pockets, the ideal operating efficiency being achieved when all of the pockets are occupied by a coin in each cycle of revolution of the disc and the latter is rotated at an optimal speed consistent with the capability of the coins to work into the pockets under the inherently unpredictable confused movements of the comingled coins jostling against the face of the transport disc.

In the characteristic operation of such machines there is an inherent agitation existing within the bulk of coins which includes a tendency to drag along with the lower portions of the disc in the direction of rotation and migrate across the hopper along the infeeding gutter to pile up in the departing corner of the hopper from which the disc begins its rise, and a further tendency for this localized agglomeration then to build up reversely back across the hopper toward the opposite or disc reentry corner and thus create a barrier across the gutter blocking entry of coins into the gutter to such an extent that the disc may rotate for periods without picking up a single coin.

In addition to the blocking difficulties described, numerous other patterns of confusion, interlocking, and shingling or wedging are peculiar to this type of bulk feeding which otherwise offers advantages in high-speed coin delivery and high coin laod capacity in comparison with other methods for counting and dispensing coins.

The foregoing and other operating difficulties characteristic of the hopper type of dispensing machine can be alleviated to varying degrees by the use of some form of coin-agitating means travelling with the disc on the face thereof and operative to stir the coins continually at the interface and gutter and thereby prevent and break up the kinds of accumulation which tend to create troublesome pile-ups and jamming.

Heretofore such machines used in coin-controlled vending, changemaking and payout apparatus have been required to handle only the smaller denominations of coins in the range from the one-cent to the twenty-five-cent coins of relatively small diameter. But currently the demand is for machines capable of handling the larger and heavier fifty-cent and one-dollar coins, and it is found that prior agitating methods and devices, some of which have been commercially acceptable for smaller coins and hopper loads, are wholly ineffectual for use with dollar coins and give rise to unacceptable levels of skipping and jamming.

The disclosed improvements have been found not only to substantially eliminate the described kinds of jamming and blocking troubles, but to increase the dispensing rate for all coin sizes to a degree not experienced with prior arrangements, especially in respect to the fifty-cent and dollar coins.

In accordance with the invention, the method of agitation utilizes an elastomeric agitating configuration carried by the transport disc and affording an over-all resiliency at least superficially present at every point and area possibly engaged by or with the coins, together with limited stiffness of a degree sufficient to impel coins vigorously in sustained stirring and agitating action without permanent distortion or deformation of the configuration by coin impact.

In accordance with further characterizing aspects of the invention, the agitating configurations may take the form of members having one or more agitating patterns and comprising elastomeric material such as natural rubber or equivalent synthetic materials including polymerized urethane, carried with the transport disc through the interface zone with the infeeding coins and extending in the sense of a radius toward the outer margins of the disc, with such thickness in a direction normal to the face of the disc structure to constitute a coin-engaging prominence which preferably is equal to the thickness of one, at least, of the largest denominations of coin the disc is intended to handle, so that at least one such coin can lodge on a sidewise margin of the configuration for transport thereby in some phase of rotation of the disc.

U.S. Pat. No. 3,942,544 and the references cited therein are representative of the current state of the art.

The foregoing and other aspects of novelty and utility characterizing the invention will be more fully understood from the following description of a preferred embodiment thereof taken with the accompanying drawings wherein:

FIG. 1 depicts schematically with parts shows sectionally the relationship between the inclined coin hopper and the transport disc in a conventional coin-handling machine of the class described;

FIG. 1-A depicts the face of a coin transport disc such as might be used in a machine according to FIG. 1 and which is equipped with two known forms of coin-agitating device typical of the state of the art;

In the usual hopper type of coin-counting and dispensing machine, such as exemplified in FIG. 1, as many as 500 coins will be loaded into the hopper —A—, which is inclined at about 30° with its lower end feeding the coins against the face of the transport discs —B—, which rotates in an inclined plane with its lower margins passing through an arcuate gutter —C— at the lower end of the hopper or disc frame and into which the infeeding coins are intended to tilt and tumble in aid to entrance into the coin-seating formations or pockets.

A device such as shown in FIG. 1 may employ one or both of the prior art forms of agitating means shown on the face of the transport disc—B— as depicted to enlarge scale in FIG. 1-A, one of which forms comprises a three-legged metallic member —D— affixed centrally to the disc and having radial projections —d— with upset edge portions —D2— forming bordering flanges, while the other agitating means comprises a plurality of conical buttons —E— protruding through holes in the disc and respectively affixed to the ends of spring spider legs —e— indicated in dotted lines and capable of yielding inwardly of the disc responsive to coin pressures and impact on the cones. Such an arrangement, while acceptably effective with smaller coins, does not afford commercially satisfactory performance with dollar coins.

Figure 3:
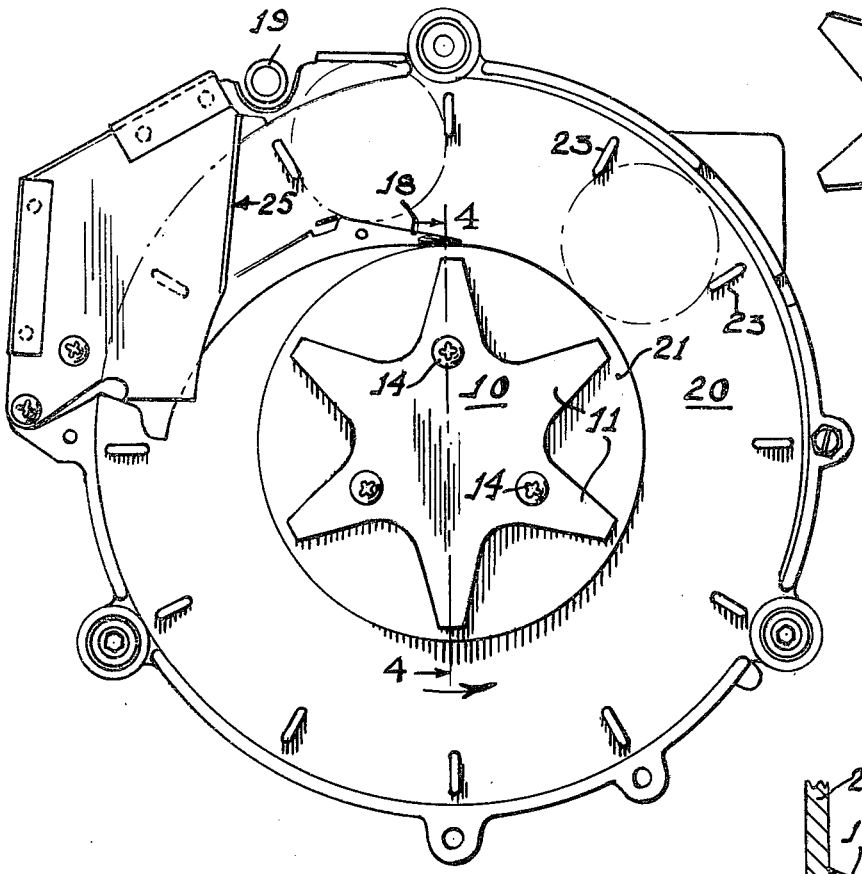
FIG. 3 is a front elevational view of a coin transport disc equipped with the novel form of agitating means seen in FIG. 2.
Figure 2:
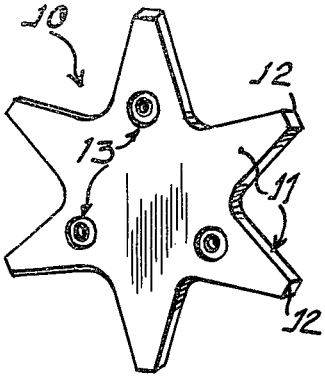
FIG. 2 is a perspective detail of a preferred from of the new agitating means.
Figure 4:
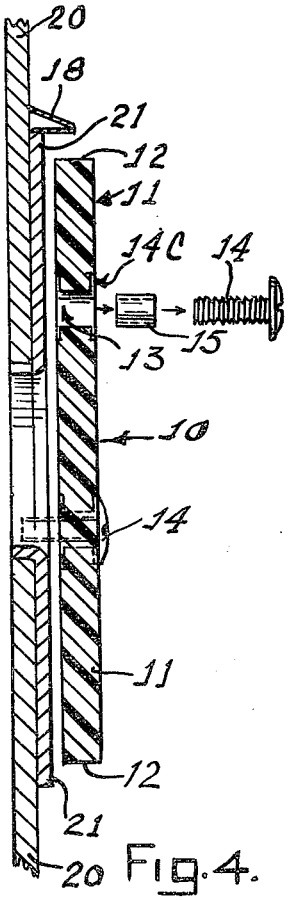
FIG. 4 is a cross-sectional detail through the disc structure and agitator as seen along lines 4-4 of FIG. 3 with parts shown fragmentally and sectionally.

The improved agitating means in the form seen in FIG. 2 comprises a monolithic body 10 of elastomeric material such as natural rubber or a synthetic elastomer such as polyurethane, such body including a central portion from which radiate a plurality of fingers 11 tapering to terminate in blunted ends 12, the body including bores 13 adapted to receive attaching screws 14, as seen in FIGS. 3 and 4, these bores being counterbored as at 14C, FIG. 4, to receive and shield the edges of the screw heads which are rounded with very shallow curvature to present gliding surfaces tubular bushings 15 limiting the penetration of the heads into the counterbore.

The radially-extensive finger configurations 11 in the embodiment of FIG. 2 are particularly effective with one-dollar coins, the relative diamenter of which is portrayed in dash-dot lines in FIG. 3 with the bottom edge of the coin resting on the rim of the circular supporting ledge plate or disc 21 attached to the face of the disc 20 and constituting part of the transport disc structure, the latter having a diameter such that the uppermost edges of the pocketed coins lie just below the peripheral margins of disc 20 whereby the coins seated on the ledge will be carried through the zenith and ride onto the ramp 18 with their upper edge portions forced beneath the pivotably-supported counting roller 19 to rock the latter in counting operation before passing into the exit guide 25.

In the construction illustrated, the infeeding coins lodge in receiving seats or pockets defined between short radially-extensive bosses 23 and the rim of the ledge disc 21. At optimally high disc speeds of 35 r.p.m., and with the inherent and stimulated agitation of the coins in the hopper, there is a frequent tendency of the pocketed coins and others dragging with the disc motion, to drop or be knocked off the ledge rim and fall back into the gutter with the possibility of creating a shingling condition, which is a form of wedging resulting when one or more coins slide face on face with others while being forced in between still other coins which are confined, so that a troublesome form of jamming results.

To alleviate this hazard, the angular space between successive agitator fingers 11 is made large enough to admit the dollar coin which can then drop into this space from the ledge plate or other position and be carried around with the agitator away from the central overlying regions of the gutter to be dumped back into the hopper at about the 8:00 o'clock disc reentry position.

There is some filling of skipped pockets as they rise with the disc at the departing or ascending side of the hopper where the accumulation of migrating coins dragging therewith tend to climb only to fall back repeatedly, and coins in this zone can lodge in the acceptance space between the fingers and be carried back to the reentry or descending side of the disc and hopper in the manner described for the dropped coins.

For such reasons and purposes, the agitator in the form of FIGS. 2 and 3 assumes the configuration of a star having as many "points" as possible consistent with the foregoing pick-up or scavenging function for the size of coin handled and the diameter of the transport disc, which in the embodiment shown can transport 12 such coins per revolution.

In furtherance of the foregoing objectives the thickness of the agitator body in this monolithic configuration will preferably be at least that of the largest coin to be handled thereby—in this case the dollar coin; and for optimum results this thickness preferably can exceed twice such coin thickness so as to afford an optimal agitating contact area in moving through the mass of coins consistent with the load specifications for the driving motor, while at the same time being able to support two coins in the intervening pick-up or scavenging spaces. In the case of the dollar coin a thickness of ¼-inch or 6.35 mm is satisfactory and affords good agitation and good coin acceptance and pick-up.

The ends 12 of the tapered fingers terminate short of the rim of the ledge disc 21 so as not to interfere with the coin-seating function of the latter, and the ends are blunted to eliminate the otherwise thin cross-section which would exist if the tapered finger came to a point, in which case the material could ultimately rupture.

The elastomeric material of which the described agitating means is formed should have a degree of stiffness or rigidity, together with a degree of resilience or yieldability which is substantially equivalent to a durometer reading of between 70 and 80 (Shore type A) for optimum results. Increasing the hardness much beyond this range proportionately decreases the performance with the approach to the hardness of the metals such as have been used heretofore for agitating appendages of various kinds.

The optimum resilience in the suggested range has another function in permitting limited flexing or deflection of the projecting parts of the agitator in a direction laterally of the plane of the body, for which purposes the fingers 11 are tapered so as to produce a diminishing cross-section toward the ends thereof, which permits a moderate yielding in the crosswise direction and in the sense of pivoting laterally of their juncture with the central body portion, for which purpose it will be observed that the screws 14 securing the agitator to the disc structure are located radially inwardly of the ends of the fingers a substantial distance leaving these ends free for laterial movement and also for bending outwardly away from the face of the plate, giving them an added freedom to yield, notwithstanding that from time to time a coin may work in behind one of these free finger ends and become temporarily captured, an event which has proved harmless since the coins quickly slip out again and the inherent reforming tendency of the material returns the fingers against the plate. This same kind of yieldability is present in the two modified agitating configurations shown in FIGS. 5 and 6.

In performance, the unitary agitator of FIGS. 2 and 3 achieves a remarkable dispensing efficiency of 5.5 coins per second using a 12-pocket disc rotating at 35 r.p.m. fed by a hopper constantly loaded with 450 dollar size coins, this rating being achieved in repeated dispensing cycles in blocks of 100,000 coins without a jam-up or other malfunction requiring manual intervention, the operation being essentially preventive and self-clearing in these respects. The comparative dispensing rate under the same hopper load and speed conditions but employing a dual prior-art type of agitation, such as shown in FIG. 1-A, is 1.8 coins per second, from which it is evident that the total-resilience agitating method and means of the disclosures provides a gain factor of more than 3.

The maximum dispensing rating for a disc with 12 pockets rotating at 35 r.p.m. with full hopper capacity containing dollar coins would be 7 coins per second, so that the 5.5 per second performance for the agitator of FIGS. 2 and 3 indicates an efficiency increased to 79%, as against the 1.8 per second performance or 26% for one of the best prior known agitating arrangements.

A further advantage of the elastomeric over-all yieldability of the new agitating means resides in its resistance to abrasion and elimination of coin-nicking potential which characterizes the metallic types, it being recognized that all deviations in uniformity and quality of the coin elements contribute variables to trouble-free operation. Thus, nicked, bent, soiled, vandalized and worn coins contribute to the generation of operating troubles, elimination of nicking potential therefore being of significance.

Figure 5:
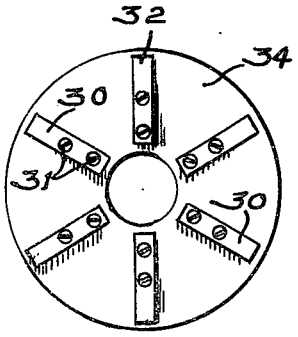
FIG. 5 depicts a transport disc equipped with a modified form of the improved agitating means.

In FIG. 5 the radially-extending finger elements 30 are independently affixed to the plate 34 by screws 31 set in accordance with the principle previously described to allow some lateral deflection for the outer endwise portions 32 of the configuration, such disjoined agitating members being formed of the same elastomeric material characterized for the monolithic form with similar optimal spacing and thickness, the taper being optional but unnecessary due to the use and choice of placement of two attaching screws for each element to afford freedom for latter deflections. This embodiment also affords a substantial increase in performance and dependability comparable with the monolithic form but requires more assembly operations in production.

Figure 6:
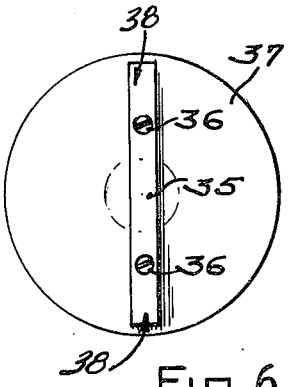
FIG. 6 illustrates a further modification of the agitating means also shown in assembly with a transport disc.

A variant monolithic form of agitator is the simple diametrically-elongated elastomeric bar 35 shown in FIG. 6 in attachment with the disc 37 by only two screws 36 again placed optimally inward from the ends 38 of the bar to afford the described lateral deflective yieldability, it being found that even this simple agitating element in elastomeric material as characterized for the form of FIGS. 2 and 3 is likewise superior to the prior art devices in use with the dollar coin.

I claim:

1. The method of transporting coins for counting and dispensing purposes in which the coins are fed from an inclined hopper against the face of a rotating transport disc in which the coins lodge for transport singly from a level at the bottom of the trough to a counting and dispensing station at a higher level, and the coins in the region of the interface between the disc and infeeding coins are agitated, characterized in that the agitation is effected by an agitating configuration carried by said disc and composed of material such as natural or synthetic rubber, imparting to said configuration a resilience at all points and surfaces exposed to impact by and with coins, and having a degree of stiffness operative to prevent permanent deformation of said configuration from coin impact and effective to repulse coins therefrom in stirring and agitation action.

2. The method of claim 1 wherein said material has a durometer factor of between 70 and 80 Shore Type A, said configuration has a thickness at least equal to the thickness of the largest denomination of coin transported, and the configuration is affixed to the interface side of the disc concentrically with its axis of rotation and its dimension of thickness standing in a direction outwardly from the plane of said side.

3. Coin counting and dispensing apparatus of the type wherein coins are fed from the lower end of an inclined hopper against the face of a rotating coin transport disc on which the coins lodge individually for transport seriatim to a counting and dispensing station at a higher level, and the coins in the interface zone between the hopper and disc are agitated by one or more projecting protuberances from the disc, characterized in that the disc carries on its face agitating means including at least one configuration standing outwardly therefrom a distance equivalent to the thickness of at least one coin of the denomination intended to be handled, and formed of elastomeric material such as natural or synthetic rubber and affording an overall resiliency at least superficially present at all points and surfaces of the configuration exposed to impact with or by coins present at said interface resulting from rotation of the disc, said material further having a degree of stiffness operative to retain its form against permanent deformation by coin impact as aforesaid, and sufficient to repel and impel coins in stirring and agitating action in said interface zone.

4. Apparatus according to claim 3 further characterized in that said material has a durometer factor ranging between 70 and 80 Shore Type A.

5. Apparatus according to claim 3 further characterized in that said configuration comprises a single monolithic member having a plurality of fingers extending in a radial sense relative to the axis of rotation of the disc.

6. Apparatus according to claim 3 wherein said configuration has the form of a star with a plurality of points spaced apart angularly about its center a distance to admit between adjoining points a coin of the diameter intended to be handled.

7. Apparatus according to claim 6 further characterized in that said points are unattached to the disc in a region adjoining the free ends thereof such that said points in said region have freedom for movement to flex laterally.

8. Apparatus according to claim 7 wherein said points have blunted ends such that the taper thereof does not terminate in a thin-webbed point likely to rupture due to repeated flexure from coin impact.

9. Apparatus according to claim 3 wherein said configuration comprises an array of a plurality of radially-extensive bars of said material attached to the interface side of the disc in predetermined uniform spaced relation angularly about the rotative axis thereof and extending in a radial sense therefrom so as to provide a coin receiving space between adjoining bars.

10. Apparatus according to claim 3 further characterized in that said configuration comprises a single member having a plurality of fingers extending in a radial sense relative to the axis of rotation of the disc.

11. In a coin-counting and dispensing machine of the hopper-fed type wherein an inclined coin transport disc rotates through a mass of coins fed against the lower face thereof to pick up and transport coins for counting and discharge at a higher level, coin-agitating means carried concentrically on the face of the disc and characterized in that such means comprises a multi-armed member having all surfaces thereof which are exposed to engagement with or by coins at least superficially resilient at all points of possible coin contact, the said member being formed of non-metallic material having a sufficient rigidity throughout resistive of permanent deformation from coin impact.

12. In coin-handling apparatus of the class described wherein a motor-driven coin transport disc rotates through a mass of infeeding coins gravitating against the face thereof to pick up the coins and carry them seriatim to a discharge station, coin-agitating means operative to stir and deflect the infeeding coins pressing against the face of the disc and comprising a body affixed concentrically with the disc to rotate therewith and stand outwardly from the plane of the face thereof and having radially-extensive finger portions terminating short of the periphery thereof, said body being formed of an abrasive-resistant material affording sufficient rigidity to maintain its configuration against permanent deformation or deflection by coin impact and sufficient stiffness to impel coins engaged thereby in rotation of the disc, as aforesaid, and further having all surfaces thereof which can be engaged with or by coins in such rotation of an elastomeric yieldability to afford limited resilience to such coin impact.

* * * * *

US004148331B1

REEXAMINATION CERTIFICATE (1894th)

United States Patent [19]

Nicolaus

[11] B1 4,148,33

[45] Certificate Issued Jan. 12, 199

[54] COIN-COUNTING AND DISPENSING APPARATUS

[75] Inventor: Frank G. Nicolaus, Chicago, Ill.

[73] Assignee: Manufacturers Hanover Trust Company

Reexamination Request:
No. 90/002,650, Feb. 18, 1992

Reexamination Certificate for:

| | |
|---|---|
| Patent No.: | **4,148,331** |
| Issued: | **Apr. 10, 1979** |
| Appl. No.: | **805,286** |
| Filed: | **Jun. 10, 1977** |

[51] Int. Cl.[5] ..... G07D 3/14
[52] U.S. Cl. ..... 453/30; 453/57
[58] Field of Search ..... 453/30, 32, 33, 34, 453/35, 49, 57; 221/203

[56] References Cited

U.S. PATENT DOCUMENTS

| | | | |
|---|---|---|---|
| 1,850,148 | 3/1932 | Brandt | 453/34 |
| 3,079,934 | 3/1963 | Thompson | 453/34 |
| 3,165,232 | 1/1965 | Stern | 221/20 |
| 3,244,319 | 4/1966 | Fessman | 221/20 |
| 3,680,566 | 8/1972 | Tanaka et al. | 453/32 |
| 3,939,954 | 2/1976 | Collins . | |
| 3,942,544 | 3/1976 | Breitenstein et al. . | |
| 3,948,280 | 4/1976 | Dahl et al. . | |

FOREIGN PATENT DOCUMENTS

| | | | |
|---|---|---|---|
| 1190732 | 5/1970 | United Kingdom | 453/3 |

*Primary Examiner*—Michael S. Huppert

[57] ABSTRACT

A coin agitating attachment for use on rotary coi transport discs fed by a coin hopper for coin-dispensin and counting machines. The attachment can be made i several configurations of elastomeric materials eac characterized by at least a superficial resiliency of lin ited stiffness such that any point of impact with or by coin presents a yieldable contact surface which is neve theless sufficiently rigid to repel and drive the coir while retaining the original shape or configuration.

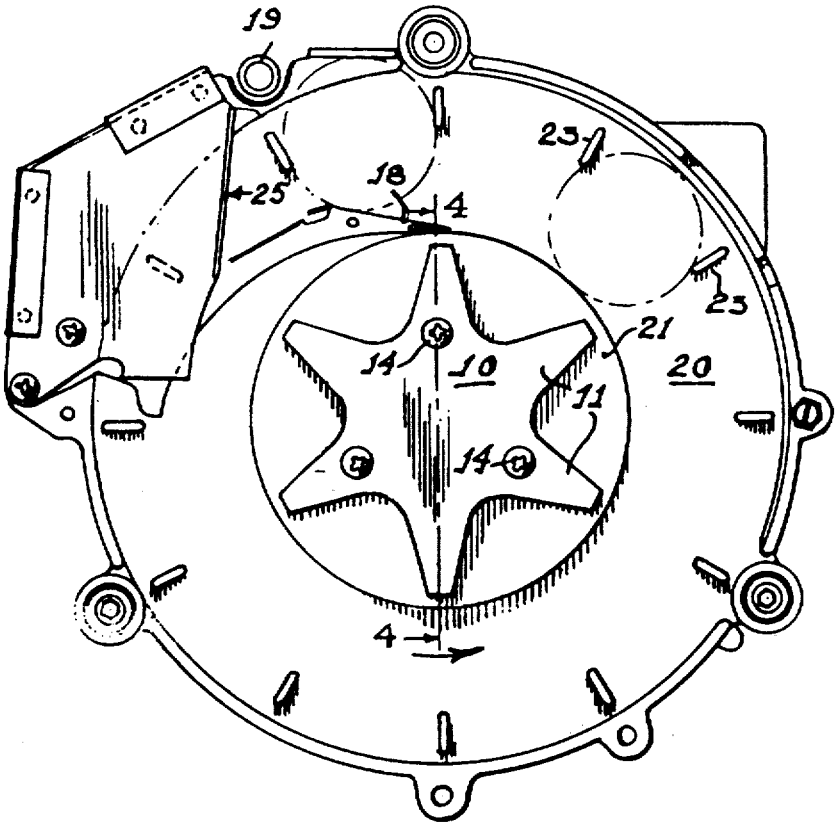

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1,2,4 and 10–12 are cancelled.

Claims 3 and 5 are determined to be patentable as amended.

Claims 6–9, dependent on an amended claim, are determined to be patentable.

3. Coin counting and dispensing apparatus of the type wherein coins are fed from the lower end of an inclined hopper against the face of a rotating coin transport disc on which the coins lodge invidiually for transport seriatim to a counting and dispensing station at a higher level, and the coins in the interface zone between the hopper and disc are agitated by one or more projecting protuberances from the disc, characterized in that the disc carries on its face agitating means including at least one configuration standing outwardly therefrom a distance equivalent to the thickness of at least one coin of the denomination intended to be handled, *said configuration comprising a single member having a plurality of fingers extending in a radial sense relative to the axis of rotation of the disc,* and formed of elastomeric material such as natural or synthetic rubber and affording an overall resiliency at least superficially present at all points and surfaces of the configuration exposed to impact with or by coins present at said interface resulting from rotation of the disc, said material further having a degree of stiffness operative to retain its form against permanent deformation by coin impact as aforesaid, and sufficient to repel and impel coins in stirring and agitating action in said interface zone.

5. Apparatus according to claim 3 further characterized in that said configuration comprises a single monolithic member [having a plurality of fingers extending in a radial sense relative to the axis of rotation of the disc].

* * * * *